US011380999B2

(12) United States Patent
Wang et al.

(10) Patent No.: US 11,380,999 B2
(45) Date of Patent: Jul. 5, 2022

(54) SLOT ANTENNA AND ELECTRONIC DEVICE

(71) Applicant: HUAWEI TECHNOLOGIES CO., LTD., Shenzhen (CN)

(72) Inventors: Hanyang Wang, Reading (GB); Jianming Li, Shenzhen (CN); Xuefei Zhang, Shenzhen (CN); Chi Liu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/027,650

(22) Filed: Sep. 21, 2020

(65) Prior Publication Data

US 2021/0005972 A1 Jan. 7, 2021

Related U.S. Application Data

(63) Continuation of application No. 15/576,723, filed as application No. PCT/CN2015/080123 on May 28, 2015, now Pat. No. 10,811,780.

(51) Int. Cl.
*H01Q 13/10* (2006.01)

(52) U.S. Cl.
CPC ..... *H01Q 13/10* (2013.01); *H01Q 13/103* (2013.01); *H01Q 13/106* (2013.01)

(58) Field of Classification Search
CPC ..... H01Q 13/10–18; H01Q 13/103; H01Q 13/106
See application file for complete search history.

(56) References Cited

U.S. PATENT DOCUMENTS

| | | | |
|---|---|---|---|
| 6,618,020 | B2 | 9/2003 | Wang et al. |
| 7,187,337 | B2 | 3/2007 | Aikawa et al. |
| 8,120,542 | B2 | 2/2012 | Shoji |
| 2002/0196191 | A1 | 12/2002 | Ngounou Kouam et al. |

(Continued)

FOREIGN PATENT DOCUMENTS

| | | | |
|---|---|---|---|
| CN | 1363968 | A | 8/2002 |
| CN | 103187615 | A | 7/2013 |

(Continued)

OTHER PUBLICATIONS

Zhe-Jun Jin et al.,"Compact Wideband Open-End Slot Antenna With Inherent Matching",IEEE Antennas and Wireless Propagation Letters, vol. 13, dated Jul. 15, 2014, pp. 1385-1388.

*Primary Examiner* — Ricardo I Magallanes
(74) *Attorney, Agent, or Firm* — Rimon PC

(57) ABSTRACT

A slot antenna comprises a printed circuit board, wherein the printed circuit board has a slot, a first capacitor, a radio frequency signal source, a transmission line, and a ground cable, wherein one end of the slot is open, and the other end is closed; the first capacitor and the ground cable are disposed on the printed circuit board, wherein the first capacitor is located on the open end of the slot; the transmission line connects the first capacitor to the radio frequency signal source; and the radio frequency signal source is configured to stimulate a feeding signal, and feed the feeding signal to the open end of the slot, wherein the radio frequency signal source connects the transmission line to the ground cable, and wherein a feed point from the radio frequency signal source to the transmission line is located outside the slot.

7 Claims, 9 Drawing Sheets

(56) References Cited

U.S. PATENT DOCUMENTS

| | | | | |
|---|---|---|---|---|
| 2004/0239575 | A1* | 12/2004 | Shoji | H01Q 5/385 343/770 |
| 2007/0164918 | A1 | 7/2007 | Kanno et al. | |
| 2012/0119963 | A1* | 5/2012 | Soekawa | H01Q 1/48 343/767 |
| 2013/0234901 | A1* | 9/2013 | Chang | H01Q 1/243 343/746 |
| 2014/0001274 | A1 | 1/2014 | Kato | |
| 2015/0009093 | A1 | 1/2015 | Taura | |
| 2016/0285167 | A1* | 9/2016 | Tsai | H01Q 13/106 |
| 2016/0336643 | A1* | 11/2016 | Pascolini | H01Q 9/0421 |

FOREIGN PATENT DOCUMENTS

| | | | |
|---|---|---|---|
| DE | 3246365 | A1 | 6/1984 |
| JP | 2006140735 | A | 6/2006 |
| JP | 2009188860 | A | 8/2009 |
| TW | 201036254 | A | 10/2010 |
| TW | I396330 | B1 | 5/2013 |
| WO | 2013145623 | A1 | 10/2013 |

* cited by examiner

C2 is adjustable

C2 is adjustable

C2 is adjustable

C2 is adjustable

C2 is adjustable

C2 is adjustable

C2 is adjustable

SLOT ANTENNA AND ELECTRONIC DEVICE

CROSS-REFERENCE TO RELATED APPLICATION

This application is a continuation of U.S. patent application Ser. No. 15/576,723, filed on Nov. 24, 2017, which a national stage of International Application No. PCT/CN2015/080123, filed on May 28, 2015. Both of the aforementioned applications are hereby incorporated by reference in their entireties.

TECHNICAL FIELD

The present disclosure relates to the antenna field, and in particular, to a slot antenna and an electronic device.

BACKGROUND

With continuous development of electronic technologies, design of electronic devices such as mobile phones develops towards thinness and metal. Therefore, slot antennas that are less sensitive to metal attract more attention.

In the prior art, a main body of a slot antenna is a printed circuit board having a slot. A length of a conventional slot antenna is a quarter of a wavelength of a working frequency. The slot antenna further includes a feeding unit. The feeding unit may be a microstrip. The microstrip extends along a position in which an open end of the slot is located and vertically crosses the slot, and a feeding point is located in a position that can enable a largest electric field of the antenna. The microstrip feeds a signal to the open end of the slot by means of coupling, to stimulate the slot antenna.

SUMMARY

To resolve the problem in the prior art that a slot antenna has a relatively high requirement on a manufacturing process, and needs relatively large space, embodiments of the present disclosure provide a slot antenna and an electronic device. The technical solutions are as follows:

According to a first aspect, a slot antenna is provided, where the slot antenna includes: a printed circuit board having a slot, a first capacitor, a radio frequency signal source, a transmission line, and a ground cable, where the printed circuit board is grounded; one end of the slot is open, and the other end is closed;

the first capacitor and the ground cable are disposed on the printed circuit board; the first capacitor is located on the open end of the slot, and is disposed on one side of the slot; and the first capacitor is connected to the radio frequency signal source by using the transmission line, and the radio frequency signal source connects the transmission line to the ground cable; and the radio frequency signal source is configured to: stimulate a feeding signal, and feed the feeding signal to the open end of the slot by using the first capacitor.

In one embodiment, the slot antenna further includes: a second capacitor, where the second capacitor is disposed on a middle part of the slot, and the second capacitor connects two sides of the slot.

In one embodiment, the second capacitor is a variable capacitor.

In one embodiment, the first capacitor is a variable capacitor.

In one embodiment, the slot is filled with a dielectric material.

According to a second aspect, a slot antenna is provided, where the slot antenna includes: a printed circuit board having a slot, a first capacitor, a radio frequency signal source, a transmission line, a ground cable, and an open radiation branch, where the printed circuit board is grounded; the open radiation branch is disposed in the slot;

the ground cable is disposed on the printed circuit board; the first capacitor is disposed on an open radiation branch, and the first capacitor is located on the open end of the slot; and the first capacitor is connected to the radio frequency signal source by using the transmission line, and the radio frequency signal source connects the transmission line to the ground cable; and the radio frequency signal source is configured to: stimulate a feeding signal, and feed the feeding signal to the open end of the slot by using the first capacitor.

In one embodiment, the slot antenna further includes: a second capacitor, where the second capacitor is disposed on a middle part of the slot, and the second capacitor connects one side of slot to the open radiation branch.

In one embodiment, the second capacitor is a variable capacitor.

In one embodiment, the first capacitor is a variable capacitor.

In one embodiment, the slot is filled with a dielectric material.

According to a third aspect, an electronic device is provided, where the electronic device includes:

at least one slot antenna according to the first aspect or any possible implementation manner of the first aspect;

and/or at least one slot antenna according to the second aspect or any possible implementation manner of the second aspect.

In one embodiment, when the electronic device includes two or more slot antennas, printed circuit boards of the two or more slot antennas are a same printed circuit board.

In one embodiment, a printed circuit board of the at least one slot antenna is a housing of the electronic device or a part of a housing of the electronic device.

The technical solutions provided in the embodiments of the present disclosure have the following beneficial effects:

A signal is fed to an open end of a slot by using a capacitor, and impedance matching can be implemented as long as a capacitor having a fixed capacitance is selected, so that a requirement on a manufacturing process is relatively low. In addition, a volume of a capacitor is relatively small, so that space occupied by a slot antenna can be reduced.

BRIEF DESCRIPTION OF DRAWINGS

To describe the technical solutions in various embodiments more clearly, the following briefly describes the accompanying drawings required for describing the embodiments. Apparently, the accompanying drawings in the following description show merely some embodiments, and a person of ordinary skill in the art may still derive other drawings from these accompanying drawings without creative efforts.

DESCRIPTION OF EMBODIMENTS

To make the objectives, technical solutions, and advantages of the present disclosure clearer, the following further describes the embodiments of the present disclosure in detail with reference to the accompanying drawings.

In a process of implementing the present disclosure, the inventor finds that the prior art has at least the following problems:

The slot antenna provided in the prior art couples and feeds a signal to an open end of a slot by using a microstrip, and it is not easy to implement impedance matching between the microstrip and the open end of the slot. Therefore, a relatively high requirement is imposed on a manufacturing process. In addition, the implementation manner of the feeding needs relatively large space.

Figure 1:
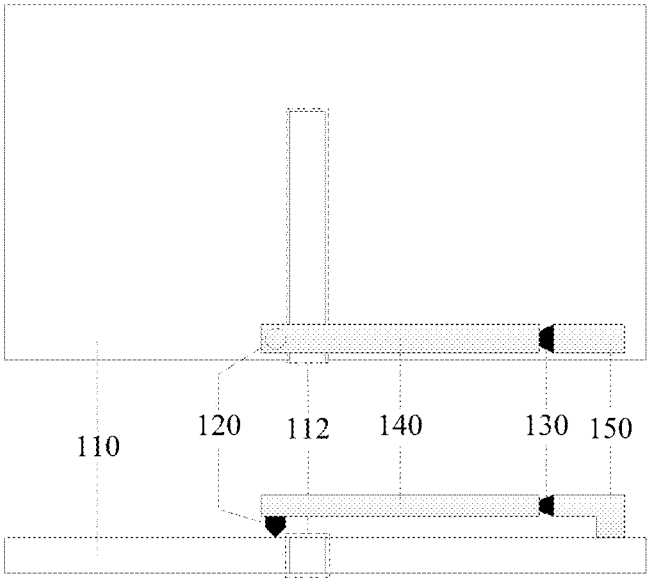
FIG. 1 is a structural diagram of a slot antenna according to the present disclosure.

Referring to FIG. 1, FIG. 1 is a structural diagram of a slot antenna according to the present disclosure. An upper half of FIG. 1 is an elevational view of the slot antenna, and a lower half of FIG. 1 is a side view of the slot antenna. As shown in FIG. 1, the slot antenna may include: a printed circuit board 110 having a slot 112, a first capacitor 120, a radio frequency signal source 130, a transmission line 140, and a ground cable 150.

The printed circuit board 110 is grounded. One end of the slot 112 is open, and the other end is closed.

The first capacitor 120 and the ground cable 150 are disposed on a printed circuit board, and the first capacitor 120 is located on an open end of the slot 112, and is clingingly disposed on one side of the slot 112.

The first capacitor 120 is connected to the radio frequency signal source 130 by using the transmission line 140, and the radio frequency signal source 130 connects the transmission line 140 to the ground cable 150. The radio frequency signal source 130 is configured to: stimulate a feeding signal, and feed the feeding signal to the open end of the slot 112 by using the first capacitor 120.

To sum up, in the slot antenna provided in this embodiment, a signal is fed to an open end of a slot by using a capacitor, and impedance matching can be implemented as long as a capacitor having a fixed capacitance is selected, so that a requirement on a manufacturing process is relatively low. In addition, a volume of a capacitor is relatively small, so that space occupied by the slot antenna can be reduced.

Figure 2A:
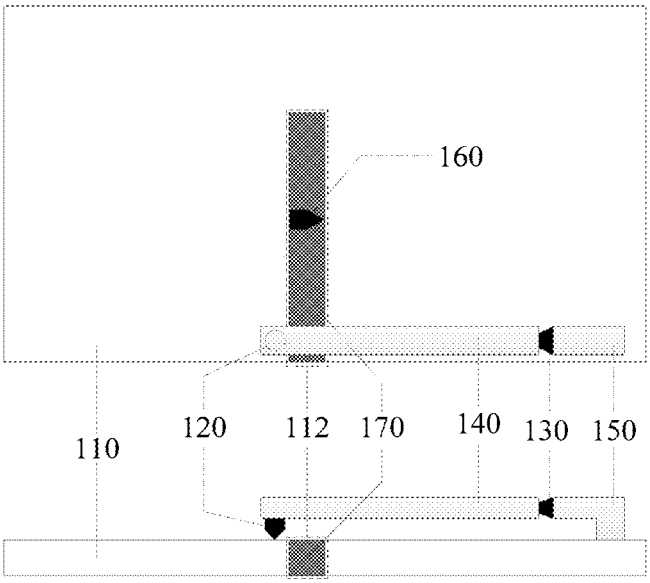
FIG. 2A is a structural diagram of a slot antenna according to another embodiment of the present disclosure.

Based on the foregoing slot antenna shown in FIG. 1, FIG. 2A is a structural diagram of a slot antenna according to another embodiment of the present disclosure. An upper half of FIG. 2A is an elevational view of the slot antenna, and a lower half of FIG. 2A is a side view of the slot antenna. As shown in FIG. 2A, the slot antenna may include: a printed circuit board 110 having a slot 112, a first capacitor 120, a radio frequency signal source 130, a transmission line 140, and a ground cable 150.

For positions and connection structures of the foregoing components, refer to FIG. 1, and details are not described herein again.

The first capacitor 120 is close or clinging to one side of the slot 112. Optionally, the first capacitor 120 may be disposed on a position that enables a largest electric field of the slot antenna. The transmission line 140 is not in contact with the printed circuit board 110, and a distance between the transmission line 140 and the printed circuit board 110 is set to a thickness of the printed circuit board.

The first capacitor 120, the radio frequency signal source 130, the transmission line 140, and the ground cable 150A constitute a feeding unit of the slot antenna. The feeding unit is configured to: generate a feeding signal and feed the feeding signal to the slot of the antenna.

It should be noted that, the structural diagrams of the slot antennas shown in FIG. 1 and FIG. 2A are used to describe connection and position relationships between the components, and do not limit actual shapes and sizes of the components and distances between the components. For example, in actual use, the radio frequency signal sources 130 shown in FIG. 1 and FIG. 2A each may be implemented as a single component, or may be implemented as an integrated circuit consisting of multiple electronic components.

In this embodiment, impedance matching of the slot antenna can be implemented as long as a capacitor having a fixed capacitance is selected, so that a requirement on a manufacturing process is relatively low. In addition, a volume of a capacitor is relatively small, so that space occupied by the slot antenna can be reduced.

Optionally, the first capacitor 120 may further be a variable capacitor.

Optionally, the slot antenna further includes: a second capacitor 160.

The second capacitor 160 is disposed on a middle part of the slot 112, and the second capacitor 160 connects two sides of the slot.

In this embodiment e, a capacitor that connects two sides of the slot may be disposed on a middle part of the slot of the slot antenna, so as to reduce a length of the slot, and reduce a size of the slot antenna.

Optionally, the second capacitor 160 may further be a variable capacitor.

In this embodiment, the first capacitor and the second capacitor may be variable capacitors. A reflection coefficient and efficiency of the slot antenna are adjusted by separately or simultaneously adjusting capacitances of the two capacitors, so as to implement independent double resonance adjustment, thereby improving efficiency and a bandwidth of performance of the slot antenna.

Figure 2B:
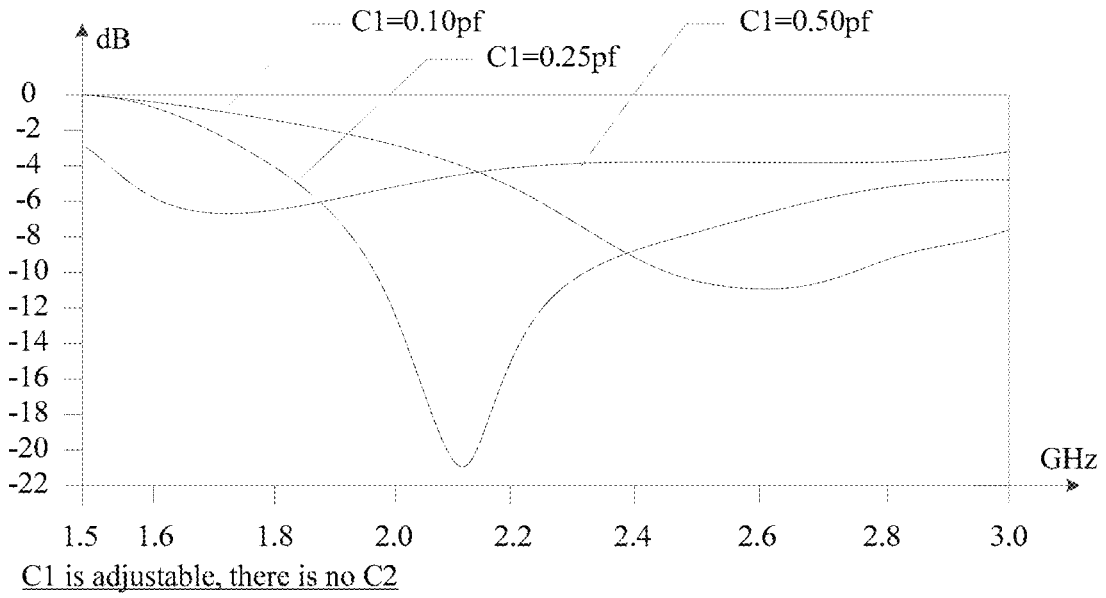
FIG. 2B is a curve chart of a relationship between a working frequency and a reflection coefficient for different C1 according to another embodiment.
Figure 2C:
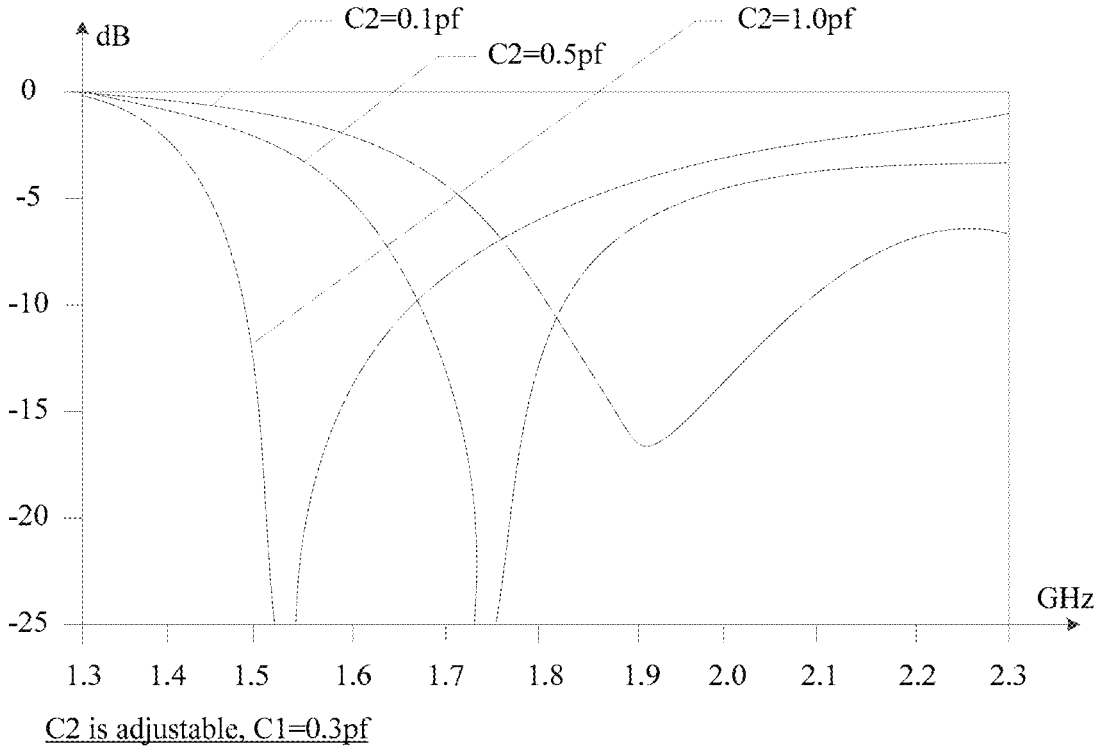
FIG. 2C is a curve chart of a relationship between a working frequency and a reflection coefficient for different C2 according to another embodiment.
Figure 2D:
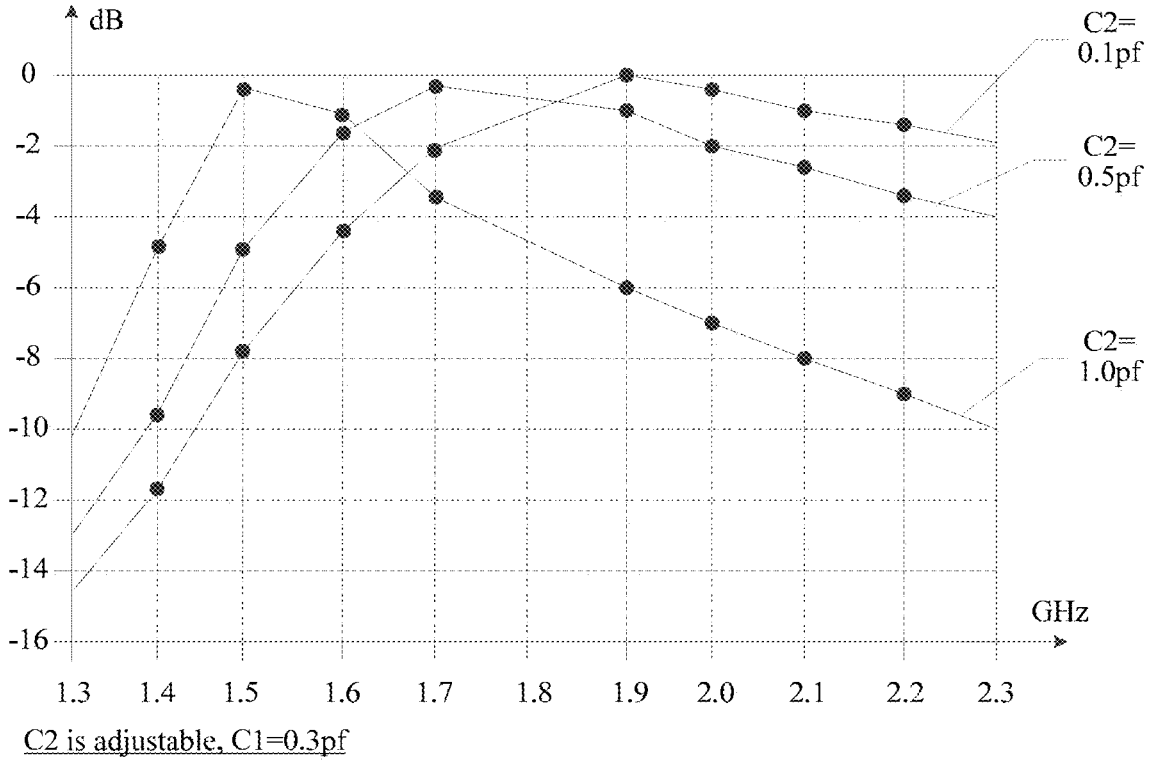
FIG. 2D is a curve chart of a relationship between a working frequency and antenna efficiency for different C2 according to another embodiment.

Specifically, it is assumed that the first capacitor 120 in FIG. 2A is a variable capacitor C1. Refer to FIG. 2B, FIG. 2C, and FIG. 2D. FIG. 2B is a curve chart of a relationship between a working frequency and an input reflection coefficient for different C1 (in this case, there is no second capacitor 160). When a capacitance of C1 is adjusted from 0.1 pF to 0.5 pF, a resonance frequency of the antenna changes from 1.7 GHz to 2.6 GHz. FIG. 2C is a curve chart of a relationship between a working frequency and an input reflection coefficient for different C2 when a capacitance of the first capacitor 120 is a fixed value 0.3 pF, and the second capacitor 160 is a variable capacitor C2. When a capacitance of C2 is adjusted from 1 pF to 0.1 pF, a resonance frequency of the antenna changes from 2.0 GHz to 1.6 GHz. FIG. 2D is a diagram of a relationship between a working frequency and antenna efficiency for different C2 when a capacitance of C1 is a fixed value 0.3 pF.

It can be seen from FIG. 2B, FIG. 2C, and FIG. 2D that a resonance frequency of the slot antenna shown in FIG. 2A may be adjusted by using either of the first capacitor and the second capacitor.

Optionally, the slot 112 may be filled with a dielectric material 170.

In this embodiment disclosure, the slot of the slot antenna may further be filled with a dielectric material, to improve the working efficiency of the slot antenna in a low frequency, thereby achieving an effect of expanding a use frequency of the slot antenna.

To sum up, in the slot antenna provided in this embodiment, a signal is fed to an open end of a slot by using a capacitor, and impedance matching can be implemented as long as a capacitor having a fixed capacitance is selected, so that a requirement on a manufacturing process is relatively low. In addition, a volume of a capacitor is relatively small, so that space occupied by the slot antenna can be reduced. In addition, another capacitor is disposed on a middle part of the slot, to reduce a size of the slot antenna. In addition, the two capacitors are both set to variable capacitors, to implement double resonance adjustment of the slot antenna, and improve performance and efficiency of the antenna. In addition, the slot may further be filled with a dielectric material, to achieve an effect of expanding a use frequency of the slot antenna.

Figure 3:
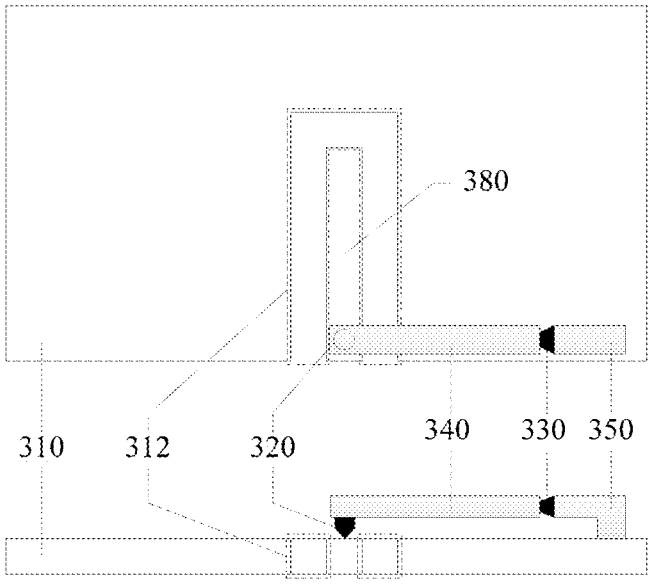
FIG. 3 is a structural diagram of a slot antenna according to the present disclosure.

The slot antenna shown in the foregoing embodiments corresponding to FIG. 1 or FIG. 2A can implement single-frequency band resonance. An embodiment further provides a slot antenna having dual-band resonance. Referring to FIG. 3, FIG. 3 is a structural diagram of the slot antenna according to this embodiment. An upper half of FIG. 3 is an elevational view of the slot antenna, and a lower half of FIG. 1 is a side view of the slot antenna. As shown in FIG. 3, the slot antenna may include: a printed circuit board 310 having a slot 312, a first capacitor 320, a radio frequency signal source 330, a transmission line 340, a ground cable 350, and an open radiation branch 380.

The printed circuit board 310 is grounded. One end of the slot 312 is open, and the other end is closed. The open radiation branch 380 is disposed in the slot 312; and the open radiation branch 380 is not in contact with the printed circuit board 310.

The ground cable 350 is disposed on the printed circuit board 310. The first capacitor 320 is disposed on the open radiation branch 380, and the first capacitor 320 is located on the open end of the slot 312.

The first capacitor 320 is connected to the radio frequency signal source 330 by using the transmission line 340, and the radio frequency signal source 330 connects the transmission line 340 to the ground cable 350. The radio frequency signal source 330 is configured to: stimulate a feeding signal, and feed the feeding signal to the open end of the slot 312 by using the first capacitor 320.

To sum up, in the slot antenna provided in this embodiment disclosure, a signal is fed to an open end of a slot by using a capacitor, and impedance matching can be implemented as long as a capacitor having a fixed capacitance is selected, so that a requirement on a manufacturing process is relatively low. In addition, a volume of a capacitor is relatively small, so that space occupied by the slot antenna can be reduced. Furthermore, an open radiation branch is disposed in the slot, and a capacitor is disposed on the open radiation branch, to implement dual-band resonance of the slot antenna, so that the slot antenna can have two resonance frequencies at the same time.

Figure 4A:
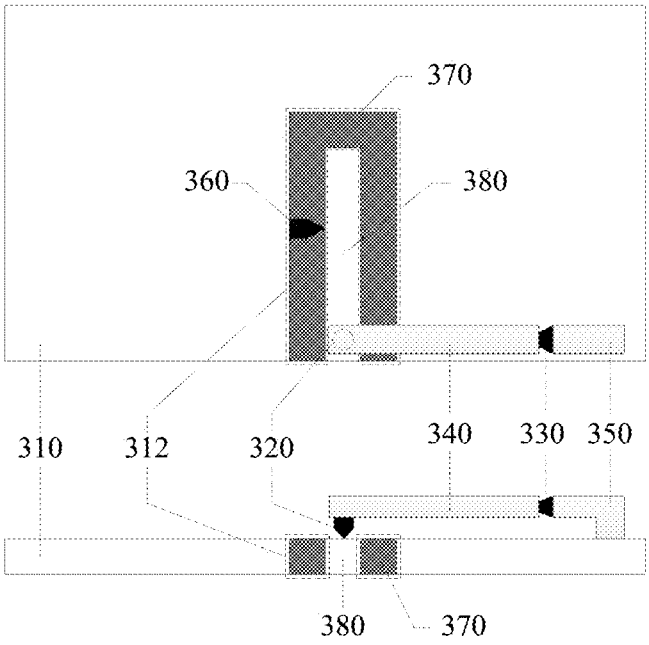
FIG. 4A is a structural diagram of a slot antenna according to another embodiment.

Based on the foregoing slot antenna shown in FIG. 3, FIG. 4A is a structural diagram of a slot antenna according to another embodiment of the present. An upper half of FIG. 4A is an elevational view of the slot antenna, and a lower half of FIG. 2A is a side view of the slot antenna. As shown in FIG. 4A, the slot antenna may include: a printed circuit board 310 having a slot 312, a first capacitor 320, a radio frequency signal source 330, a transmission line 340, a ground cable 350, and an open radiation branch 380.

For positions and connection structures of the foregoing components, refer to FIG. 1, and details are not described herein again.

Optionally, the first capacitor 320 may be disposed on a position that enables a largest electric field of the slot antenna. The transmission line 340 is not in contact with the printed circuit board 310, and a distance between the transmission line 340 and the printed circuit board 310 is set to a thickness of the printed circuit board.

The first capacitor 320, the radio frequency signal source 330, the transmission line 340, and the ground cable 350 constitute a feeding unit of the slot antenna. The feeding unit is configured to: generate a feeding signal and feed the feeding signal to the slot of the antenna.

It should be noted that, the structural diagrams of the slot antennas shown in FIG. 3 and FIG. 4A are used to describe connection and position relationships between the components, and do not limit actual shapes and sizes of the components and distances between the components.

In this embodiment, impedance matching of the slot antenna can be implemented as long as a capacitor having a fixed capacitance is selected, so that a requirement on a manufacturing process is relatively low. In addition, a volume of a capacitor is relatively small, so that space occupied by the slot antenna can be reduced. Furthermore, an open radiation branch is disposed in a slot, and a capacitor is disposed on an open radiation branch, to implement dual-band resonance of the slot antenna, so that the slot antenna can have two resonance frequencies at the same time.

Optionally, the first capacitor 320 may be a variable capacitor.

Optionally, the slot antenna further includes: a second capacitor 360.

The second capacitor 360 is disposed on a middle part of the slot 312, and the second capacitor 360 connects one side of the slot 312 and the open radiation branch 380.

In this embodiment, a capacitor that connects one side of the slot and an open radiation branch may be disposed on a middle part of the slot of the slot antenna, so as to reduce a length of the slot, and reduce a size of the slot antenna.

Optionally, the second capacitor 360 may be a variable capacitor.

In this embodiment, the first capacitor and the second capacitor may be variable capacitors. A reflection coefficient and efficiency of the slot antenna are adjusted by separately or simultaneously adjusting capacitances of the two capacitors, so as to implement independent double resonance adjustment, thereby improving efficiency and a bandwidth of performance of the slot antenna.

Figure 4B:
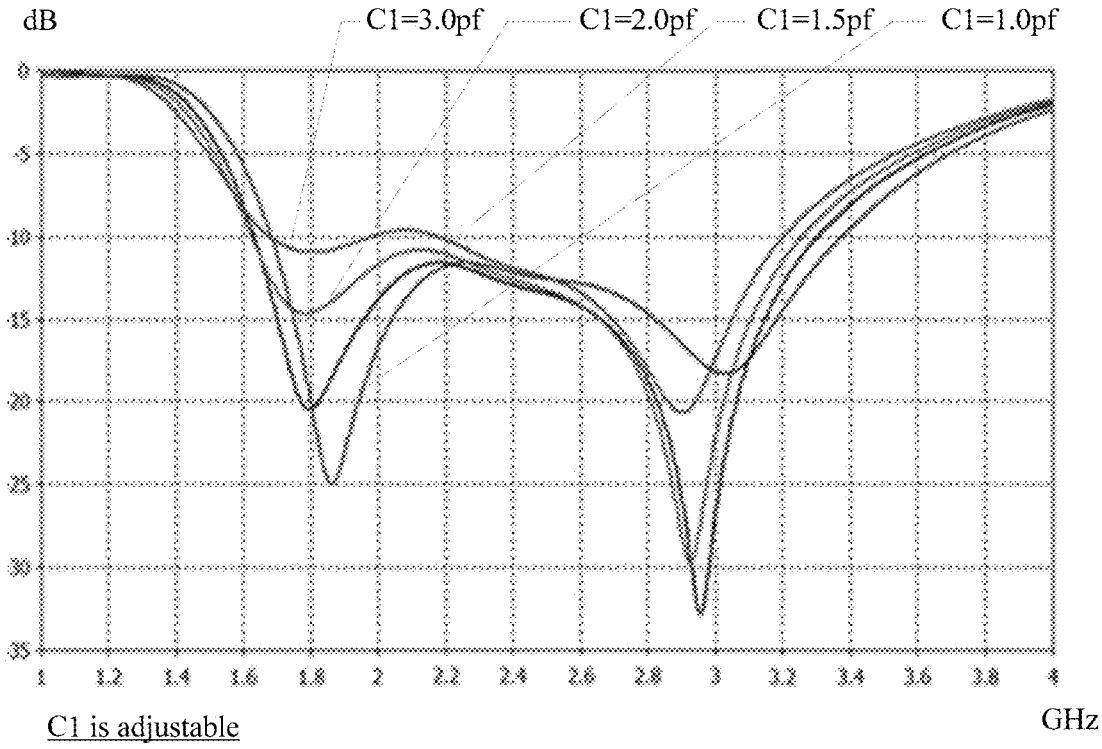
FIG. 4B is a curve chart of a relationship between a working frequency and a reflection coefficient for different C1 according to another embodiment.
Figure 4C:
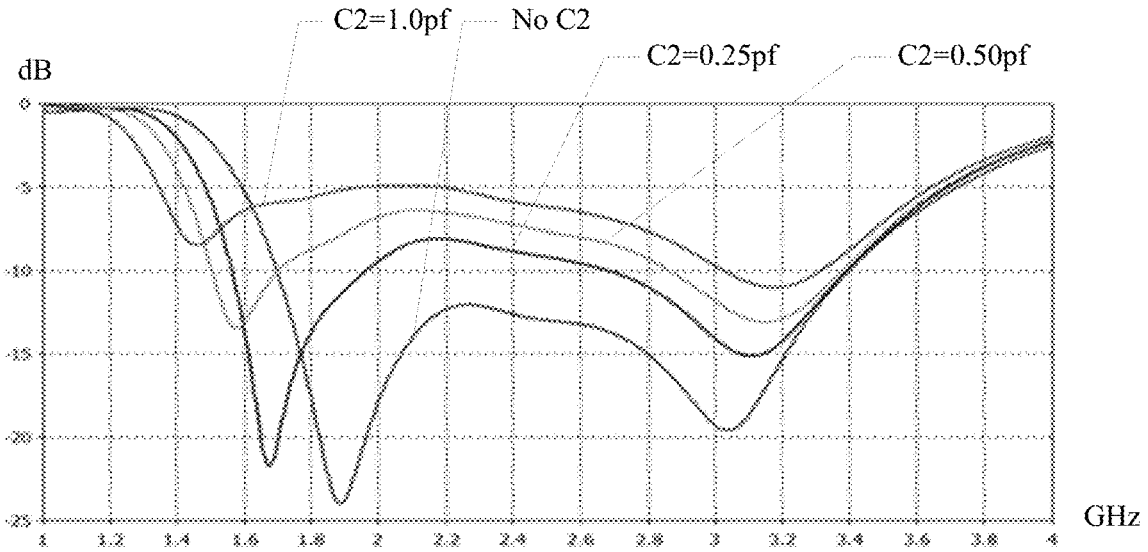
FIG. 4C is a curve chart of a relationship between a working frequency and a reflection coefficient for different C2 according to another embodiment.
Figure 4D:
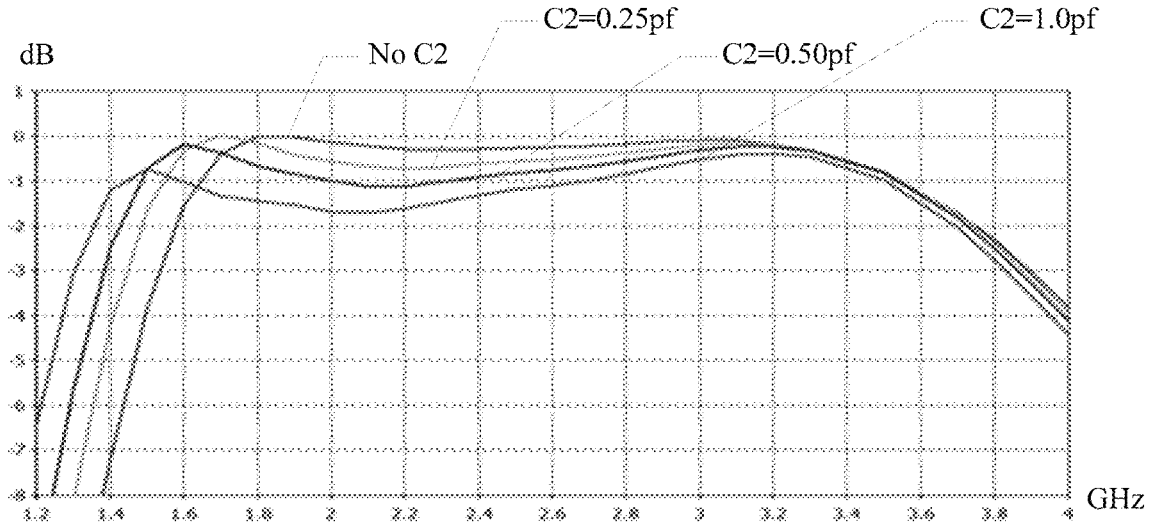
FIG. 4D is a curve chart of a relationship between a working frequency and antenna efficiency for different C2 according to another embodiment.

Specifically, it is assumed that the first capacitor 320 in FIG. 4A is a variable capacitor C1. Referring to FIG. 4B, FIG. 4C, and FIG. 4D, FIG. 4B is a curve chart of a relationship between a working frequency and a reflection coefficient for different C1, FIG. 4C is a curve chart of a relationship between a working frequency and a reflection coefficient for different C2, and FIG. 4D is a curve chart of a relationship between a working frequency and antenna efficiency for different C2.

It can be seen from FIG. 4B, FIG. 4C, and FIG. 4D that a resonance frequency of the slot antenna shown in FIG. 4A may be adjusted by using either of the first capacitor and the second capacitor.

Optionally, the slot 312 is filled with a dielectric material 370.

In this embodiment, the slot of the slot antenna may further be filled with a dielectric material, to improve the working efficiency of the slot antenna in a low frequency, thereby achieving an effect of expanding a use frequency of the slot antenna.

To sum up, in the slot antenna provided in this embodiment, a signal is fed to an open end of a slot by using a capacitor, and impedance matching can be implemented as long as a capacitor having a fixed capacitance is selected, so that a requirement on a manufacturing process is relatively low. In addition, a volume of a capacitor is relatively small, so that space occupied by the slot antenna can be reduced. Furthermore, an open radiation branch is disposed in the slot, and a capacitor is disposed on the open radiation branch, to implement dual-band resonance of the slot antenna, so that the slot antenna can have two resonance frequencies at the same time. In addition, another capacitor is disposed on a middle part of the slot, to reduce a size of the slot antenna. In addition, the two capacitors are both set to variable capacitors, to implement double resonance adjustment of the slot antenna, and improve performance and efficiency of the antenna. In addition, the slot may further be filled with a dielectric material, to achieve an effect of expanding a use frequency of the slot antenna.

The slot antenna shown in the foregoing embodiment further has an advantage of relatively high isolation between a high frequency and a low frequency, and it is easy to implement multiple-antenna design in a same electronic device. Specifically, the present disclosure further provides an electronic device. The electronic device may include: at least one slot antenna shown in FIG. 1 or FIG. 2A, and/or, at least one slot antenna shown in FIG. 3 or FIG. 4A.

Optionally, when the electronic device includes two or more slot antennas, printed circuit boards of the two or more slot antennas are a same printed circuit board.

Optionally, a printed circuit board of the at least one slot antenna is a housing of the electronic device or a part of a housing of the electronic device.

Figure 5A:
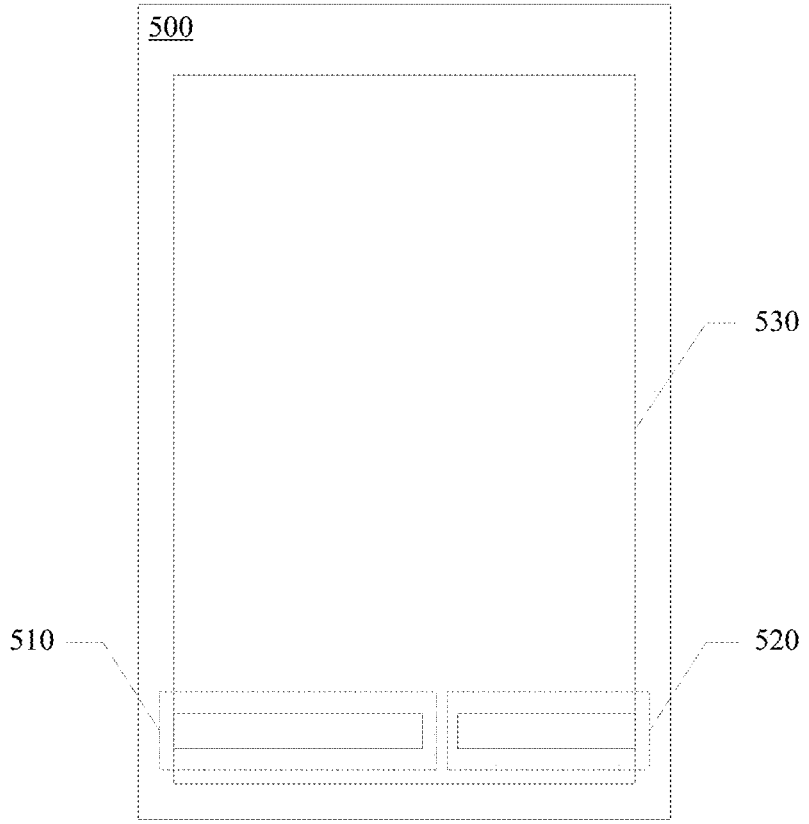
FIG. 5A is a device composition diagram of an electronic device according to the present disclosure.
Figure 5B:
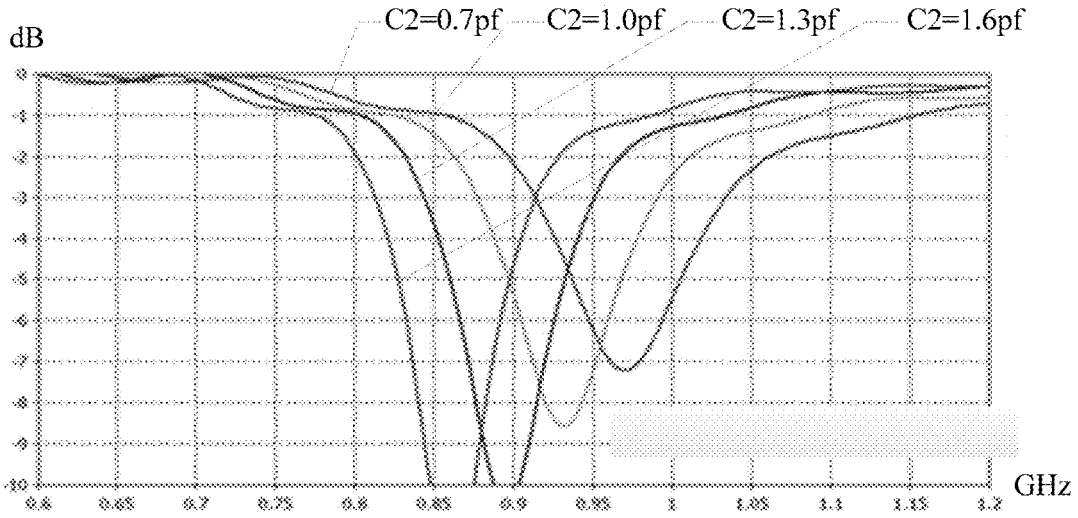
FIG. 5B is a curve chart of a relationship between a working frequency and an input reflection coefficient of a first slot antenna for different C2 according to the present disclosure.

Specifically, referring to FIG. 5A, FIG. 5A is a device composition diagram of an electronic device according to the present disclosure. As shown in FIG. 5A, an electronic device 500 includes: a first slot antenna 510 having a low working frequency and a second slot antenna 520 having a high working frequency.

The first slot antenna 510 and the second slot antenna 520 share one printed circuit board 530. A slot of the first slot antenna 510 and a slot of the second slot antenna 520 are in a linear shape and are respectively disposed on two sides of the printed circuit board 530, and there is a particular distance between the two slots.

The first slot antenna 510 may be implemented as the foregoing slot antenna shown in FIG. 2A. For position and connection relationships of components included in the slot antenna, refer to FIG. 2A, and details are not described herein again.

The second slot antenna 520 may be implemented as the foregoing slot antenna shown in FIG. 4A. For position and connection relationships of components included in the slot antenna, refer to FIG. 4A, and details are not described herein again.

Figure 5C:
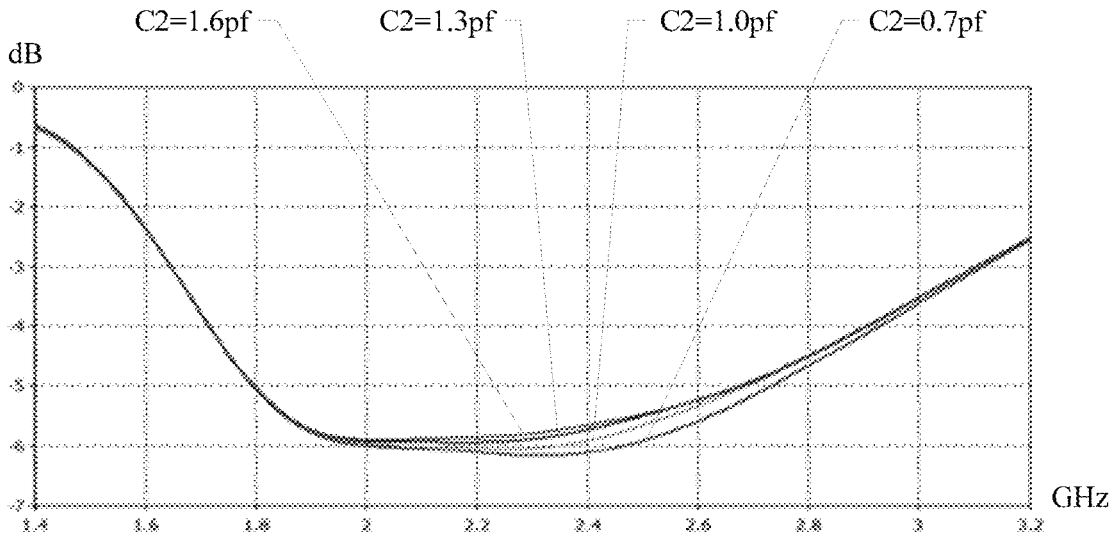
FIG. 5C is a curve chart of a relationship between a working frequency and an output reflection coefficient of a second slot antenna for different C2 according to the present disclosure.
Figure 5D:
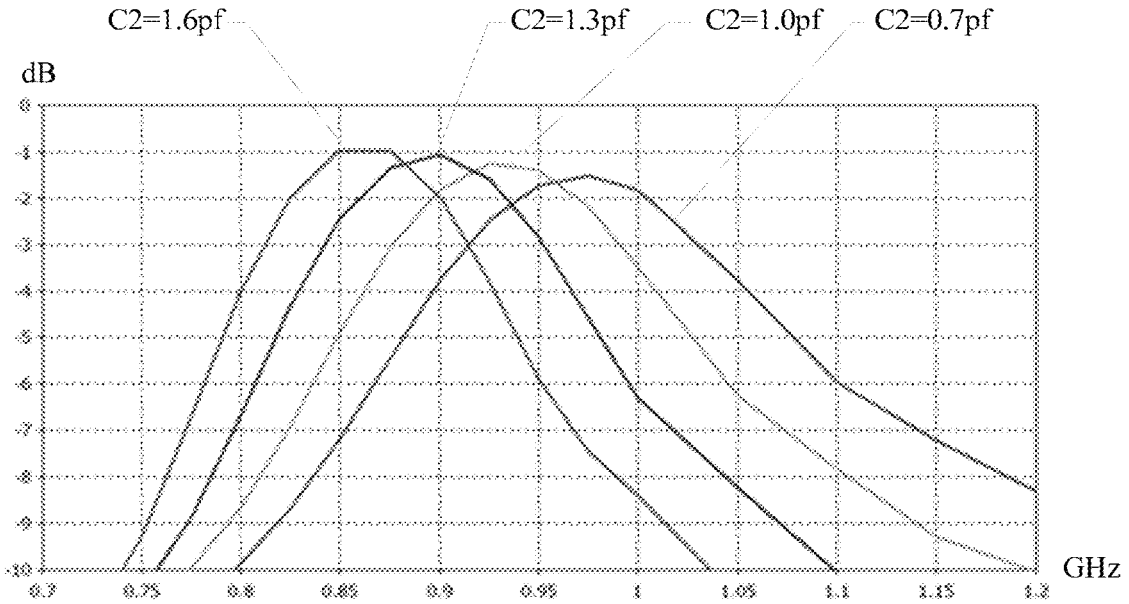
FIG. 5D is a curve chart of a relationship between a working frequency and antenna efficiency of a first slot antenna for different C2 according to the present disclosure.
Figure 5E:
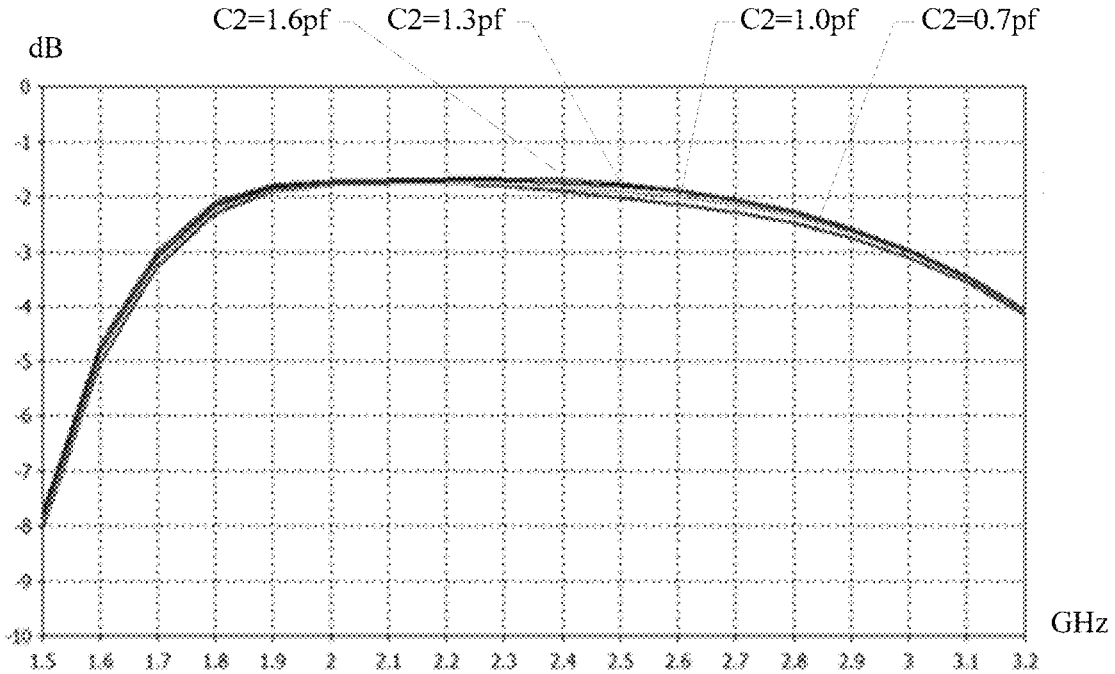
FIG. 5E is a curve chart of a relationship between a working frequency and antenna efficiency of a second slot antenna for different C2 according to the present disclosure.

Using that the first slot antenna 510 includes a first capacitor (a capacitance is C1) and a second capacitor (a capacitance is C2), the second slot antenna 520 includes only a first capacitor (a capacitance is C3), C1=0.8 pF, C3=1.6 pF, and C2 is adjustable as an example, and referring to FIG. 5B, FIG. 5C, FIG. 5D, and FIG. 5E, FIG. 5B is a curve chart of a relationship between a working frequency and an input reflection coefficient of the first slot antenna for different C2, FIG. 5C is a curve chart of a relationship between a working frequency and an output reflection coefficient of the second slot antenna for different C2, FIG. 5D is a curve chart of a relationship between a working frequency and antenna efficiency of the first slot antenna for different C2, and FIG. 5E is a curve chart of a relationship between a working frequency and antenna efficiency of the second slot antenna for different C2.

It can be seen from FIG. 5B to FIG. 5E that resonance frequencies of the first slot antenna and the second slot antenna shown in FIG. 5A may be adjusted by using the second capacitor of the first slot antenna. That is, the double-feeding antenna shown in this embodiment implements a solution of independent high and low frequency adjustment, so that use of Diplexer components (diplexer) can be reduced, and a difference loss is reduced.

Figure 5F:
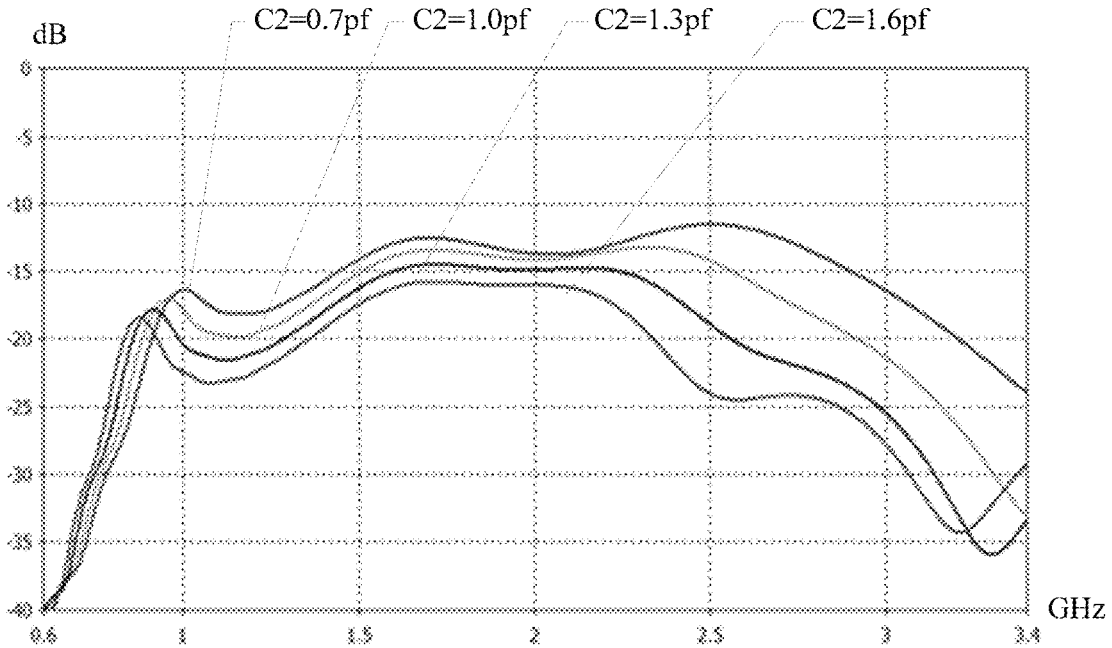
FIG. 5F is a curve chart of a relationship between a working frequency and antenna efficiency of a first slot antenna, and a relationship between a working frequency and antenna efficiency of a second slot antenna for different C2 according to the present disclosure.

In addition, referring to FIG. 5F, FIG. 5F is a curve chart of a relationship between a working frequency and antenna efficiency of the first slot antenna, and a relationship between a working frequency and antenna efficiency of the second slot antenna for different C2. As can be seen from FIG. 5F, the first slot antenna and the second slot antenna shown in FIG. 5A has relatively good isolation between a high frequency and a low frequency, and are applicable to an antenna solution of carrier aggregation (CA).

Figure 5G:
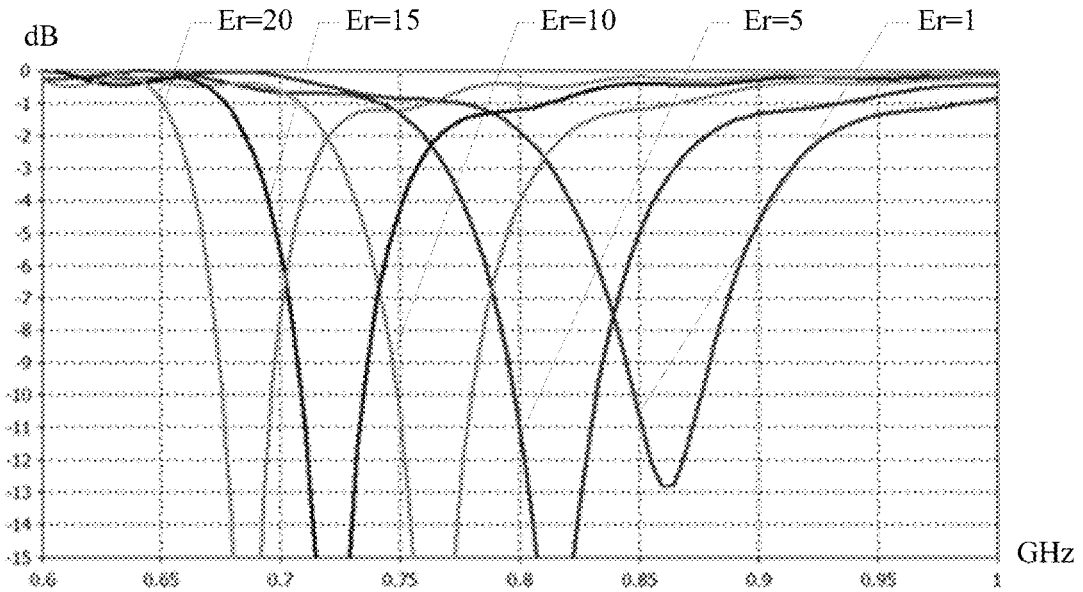
FIG. 5G is a curve chart of a relationship between an input reflection coefficient and a working frequency of a first slot antenna for different dielectric coefficients of a dielectric material according to the present disclosure.
Figure 5H:
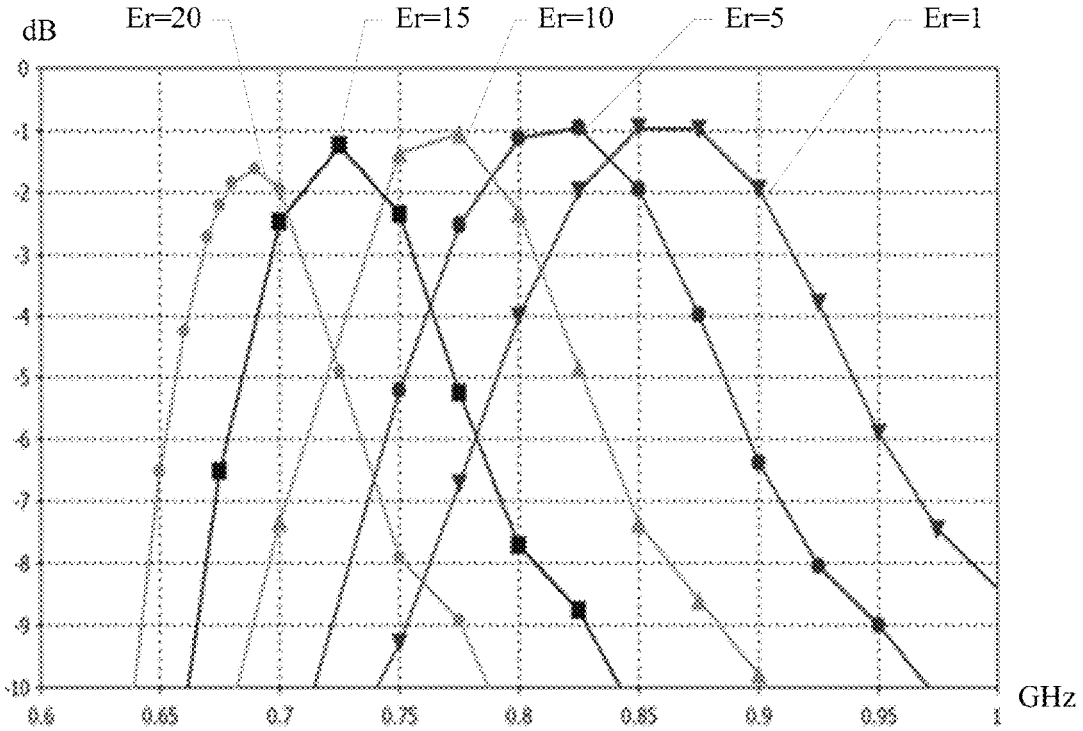
FIG. 5H is a curve chart of a relationship between antenna efficiency and a working frequency of a first slot antenna for different dielectric coefficients of a dielectric material according to the present disclosure.

In the electronic device provided in this embodiment, a dielectric material may be filled between the first slot antenna 510 and the second slot antenna 520. Specifically, using that C1=0.8 pF, C2=2.5 pF, and C3=1.6 pF as an example, referring to FIG. 5G and FIG. 5H, FIG. 5G is a curve chart of a relationship between an input reflection coefficient and a working frequency of the first slot antenna 510 for different dielectric coefficients of a dielectric material, and FIG. 5H is a curve chart of a relationship between antenna efficiency and a working frequency of the first slot antenna 510 for different dielectric coefficients of a dielectric material. It can be seen that when the slot is filled with a dielectric material and the first slot antenna works at a super low frequency (650-800 MHz), a relatively good input reflection coefficient and relatively good antenna efficiency can also be obtained.

A person of ordinary skill in the art may understand that all or some of the steps of the embodiments may be implemented by hardware or a program instructing related hardware. The program may be stored in a computer-readable storage medium. The storage medium may include: a read-only memory, a magnetic disk, or an optical disc.

The foregoing descriptions are merely example embodiments of the present disclosure, but are not intended to limit the present disclosure. Any modification, equivalent replacement, and improvement made without departing from the spirit and principle of the present disclosure shall fall within the protection scope of the present disclosure.

What is claimed is:

1. A slot antenna, comprising: a printed circuit board, wherein the printed circuit board comprises a slot, a first capacitor, a radio frequency signal source, a transmission line, and a ground cable, wherein the printed circuit board is grounded, wherein one end of the slot is open, and the other end is closed; the first capacitor and the ground cable are disposed on the printed circuit board, wherein the first capacitor is located on the open end of the slot; the transmission line connects the first capacitor to the radio frequency signal source; and the radio frequency signal source is configured to: stimulate a feeding signal, and feed the feeding signal to the open end of the slot by using the first capacitor, wherein the radio frequency signal source connects the transmission line to the ground cable, and wherein a feed point from the radio frequency signal source to the transmission line is located outside the slot; wherein the slot antenna further comprises: a second capacitor, wherein the second capacitor is disposed at a middle part of the slot, and the second capacitor connects two sides of the slot, and wherein the first capacitor and the second capacitor are variable capacitors.

2. The slot antenna according to claim 1, wherein the slot is filled with a dielectric material.

3. An electronic device, comprising: a slot antenna, wherein the slot antenna comprises: a printed circuit board having a slot, a first capacitor, a radio frequency signal source, a transmission line, a ground cable, wherein the printed circuit board is grounded, wherein one end of the slot is open and the other end is closed; the first capacitor and the ground cable are disposed on the printed circuit board, wherein the first capacitor is located on the open end of the slot; the transmission line connects the first capacitor to the radio frequency signal source; and the radio frequency signal source is configured to: stimulate a feeding signal, and feed the feeding signal to the open end of the slot by using the first capacitor, wherein the radio frequency signal source connects the transmission line to the ground cable, and wherein a feed point from the radio frequency signal source to the transmission line is located outside the slot; wherein the slot antenna further comprises: a second capacitor, wherein the second capacitor is disposed at a middle part of the slot, and the second capacitor connects two sides of the slot, and wherein the first capacitor and the second capacitor are variable capacitors.

4. The electronic device according to claim 3, wherein the slot is filled with a dielectric material.

5. The electronic device according to claim 3, wherein when the electronic device comprises two slot antennas, printed circuit boards of the two slot antennas are a same printed circuit board.

6. The electronic device according to claim 3, wherein a printed circuit board of the slot antenna is a housing of the electronic device.

7. The electronic device according to claim 3, wherein a printed circuit board of the slot antenna is a part of a housing of the electronic device.

* * * * *